US011311152B2

(12) United States Patent
Rozek

(10) Patent No.: US 11,311,152 B2
(45) **Date of Patent: *Apr. 26, 2022**

(54) SPINDLE ASSEMBLY FOR SHEET PRODUCT DISPENSERS

(71) Applicant: GPCP IP HOLDINGS LLC, Atlanta, GA (US)

(72) Inventor: Roy J. Rozek, Neenah, WI (US)

(73) Assignee: GPCP IP HOLDINGS LLC, Atlanta, GA (US)

( * ) Notice: Subject to any disclaimer, the term of this patent is extended or adjusted under 35 U.S.C. 154(b) by 135 days.

This patent is subject to a terminal disclaimer.

(21) Appl. No.: 16/922,070

(22) Filed: Jul. 7, 2020

(65) Prior Publication Data

US 2020/0329924 A1 Oct. 22, 2020

Related U.S. Application Data

(63) Continuation of application No. 16/145,876, filed on Sep. 28, 2018, now Pat. No. 10,743,723.

(51) Int. Cl.
*A47K 10/38* (2006.01)

(52) U.S. Cl.
CPC ..... *A47K 10/38* (2013.01); *A47K 2010/3863* (2013.01); *B65H 2701/1862* (2013.01)

(58) Field of Classification Search
CPC ..... A47K 10/38; A47K 10/3836; A47K 2010/3863; B65H 2701/1862
See application file for complete search history.

(56) References Cited

U.S. PATENT DOCUMENTS

| | | | |
|---|---|---|---|
| 676,335 | A | 6/1901 | Moffatt |
| 805,011 | A | 11/1905 | Gomber |
| 1,281,861 | A | 10/1918 | Sibley |

(Continued)

FOREIGN PATENT DOCUMENTS

| | | |
|---|---|---|
| CA | 1072504 | 2/1980 |
| CA | 2130524 | 2/1996 |

(Continued)

OTHER PUBLICATIONS

U.S. Appl. No. 16/145,890, filed Sep. 28, 2018, entitled "Spindles and Dispensers for Sheet Product".

(Continued)

*Primary Examiner* — William E Dondero
(74) *Attorney, Agent, or Firm* — Nelson Mullins Riley & Scarborough LLP

(57) ABSTRACT

An assembly for supporting a roll of sheet product with respect to a sheet product dispenser is provided including a mandrel configured to be positioned within a housing of the dispenser and a spindle. The spindle includes a spindle body positioned over the mandrel and configured to be received within a central opening of the roll. The spindle includes first and second sets of friction elements extending away from respective ends of the spindle body. Each friction element is configured to extend radially inward from the spindle body so as to provide a contact force against the mandrel when the spindle is installed on the mandrel. The contact forces applied against the mandrel may be designed to be constant irrespective of whether the roll of sheet product is installed on the spindle and/or if the inner surface of the central opening of the roll of sheet product has any inconsistencies.

20 Claims, 10 Drawing Sheets

(56) References Cited

U.S. PATENT DOCUMENTS

| | | | |
|---|---|---|---|
| 1,928,979 | A | 10/1933 | Levison |
| 2,248,716 | A | 7/1941 | Markle, Jr. |
| 2,443,243 | A | 6/1948 | Hayssen |
| 2,952,418 | A | 9/1960 | Rice |
| 3,211,504 | A | 10/1965 | Bump |
| 3,285,528 | A | 11/1966 | Beindorf |
| 3,375,995 | A | 4/1968 | Roman |
| 3,788,573 | A | 1/1974 | Thomson et al. |
| 3,917,185 | A | 11/1975 | Canada et al. |
| 4,067,511 | A | 1/1978 | Heimanns |
| 4,149,682 | A | 4/1979 | Gustafson et al. |
| 4,300,727 | A | 11/1981 | Koch et al. |
| 4,354,644 | A | 10/1982 | Grant |
| 4,436,249 | A | 3/1984 | Santa Lucia et al. |
| 4,447,015 | A | 5/1984 | Peterson |
| 5,366,175 | A | 11/1994 | Schutz |
| 5,370,336 | A | 12/1994 | Whittington |
| 5,370,339 | A | 12/1994 | Moody et al. |
| 5,374,008 | A | 12/1994 | Halvorson et al. |
| 5,445,345 | A | 8/1995 | Neveu et al. |
| 5,451,013 | A | 9/1995 | Schutz |
| 5,467,935 | A | 11/1995 | Moody |
| 5,495,997 | A | 3/1996 | Moody |
| 5,509,593 | A | 4/1996 | Bloch et al. |
| 5,524,835 | A | 6/1996 | Collins |
| 5,645,244 | A | 7/1997 | Moody |
| 5,803,399 | A | 9/1998 | Hashikawa |
| 5,813,624 | A | 9/1998 | Grasso et al. |
| 5,868,342 | A | 2/1999 | Moody et al. |
| 5,904,316 | A | 5/1999 | Dunning et al. |
| 6,036,134 | A | 3/2000 | Moody |
| 6,056,235 | A | 5/2000 | Brozinsky |
| 6,155,517 | A | 12/2000 | Lippold et al. |
| 6,202,956 | B1 | 3/2001 | Grasso et al. |
| 6,241,180 | B1 | 6/2001 | Potter |
| 6,902,133 | B1 | 6/2005 | Black |
| 7,083,138 | B2 | 8/2006 | Elliott et al. |
| 7,395,986 | B1 | 7/2008 | Haering |
| 7,422,174 | B2 | 9/2008 | Elliott et al. |
| 7,841,558 | B2 | 11/2010 | Elliott et al. |
| 7,861,964 | B2 | 1/2011 | Cittadino et al. |
| D703,461 | S | 4/2014 | Myron |
| 9,648,995 | B2 | 5/2017 | Elliott et al. |
| 9,918,598 | B2 | 3/2018 | Osborne |
| 2003/0106957 | A1 | 6/2003 | Seybold et al. |
| 2005/0067424 | A1 | 3/2005 | Duff |
| 2005/0139721 | A1 | 6/2005 | Andersson |
| 2008/0035696 | A1 | 2/2008 | Nichols et al. |
| 2009/0057169 | A1 | 3/2009 | Kruchoski et al. |
| 2009/0236464 | A1 | 9/2009 | Cittadino et al. |
| 2010/0213303 | A1 | 8/2010 | Sanders |
| 2010/0236956 | A1 | 9/2010 | Kling et al. |
| 2012/0097790 | A1 | 4/2012 | Wilkins et al. |
| 2012/0104142 | A1 | 5/2012 | Phelps |
| 2012/0104143 | A1 | 5/2012 | Phelps |
| 2012/0111987 | A1 | 5/2012 | Phelps |
| 2014/0367507 | A1 | 12/2014 | Trampolski |
| 2015/0307315 | A1 | 10/2015 | Techlin et al. |
| 2016/0037979 | A1 | 2/2016 | Mattheeussen et al. |
| 2017/0071421 | A1 | 3/2017 | Hagleitner |
| 2018/0146829 | A1 | 5/2018 | Osborne |
| 2018/0325333 | A1 | 11/2018 | Murphy et al. |

FOREIGN PATENT DOCUMENTS

| | | | |
|---|---|---|---|
| CA | 2 414 887 | A1 | 6/2003 |
| CA | 2 615 407 | A1 | 6/2008 |
| CA | 2 879 799 | A1 | 2/2014 |
| EP | 0 479 544 | A2 | 4/1992 |
| EP | 0 595 008 | A1 | 5/1994 |
| EP | 0 698 367 | A1 | 2/1996 |
| EP | 0 758 539 | A1 | 2/1997 |
| EP | 1 146 003 | A2 | 10/2001 |
| EP | 1559357 | A2 | 8/2005 |
| FR | 2652735 | A1 | 4/1991 |
| FR | 2669013 | A1 | 5/1992 |
| FR | 2750969 | A1 | 1/1998 |
| GB | 1 385 725 | | 2/1975 |
| NL | 78196 | C | 1/1955 |
| SE | 520326 | C2 | 6/2003 |
| WO | WO 93/10700 | A1 | 6/1993 |
| WO | WO 97/04699 | A1 | 2/1997 |
| WO | WO 97/37918 | A1 | 10/1997 |
| WO | WO 98/17924 | A1 | 4/1998 |
| WO | WO 2007/111561 | A1 | 10/2007 |
| WO | WO 2008/004919 | A1 | 1/2008 |
| WO | WO 2008/004920 | A1 | 1/2008 |
| WO | WO 2010/011165 | A1 | 1/2010 |
| WO | WO 2011/002360 | A1 | 1/2011 |
| WO | WO 2014/007690 | A1 | 1/2014 |
| WO | WO 2017/084689 | A1 | 5/2017 |

OTHER PUBLICATIONS

GP Compact Black Side-by-Side Double Roll Toilet Paper Dispenser (3 pgs.) Website visited Feb. 25, 2019 https://catalog.gppro.com/CATALOG/6281/29381?FILTER=full.

Feb. 4, 2020 Search Report and Written Opinion issued in International Patent Application No. PCT/US2019/053195.

SPINDLE ASSEMBLY FOR SHEET PRODUCT DISPENSERS

CROSS REFERENCE TO RELATED APPLICATIONS

This application claims priority to and is a continuation of U.S. Nonprovisional patent application Ser. No. 16/145,876, entitled "Spindle Assembly for Sheet Product Dispensers", filed Sep. 28, 2018; which is hereby incorporated by reference in its entirety.

FIELD OF THE INVENTION

Example embodiments of the present invention generally relate to sheet product dispensers and, more particularly to, spindle assemblies for sheet product dispensers.

BACKGROUND

Sheet product dispensers (e.g., napkin dispensers, paper towel dispensers, and tissue dispensers), provide on-demand sheet product to a user from a supply of sheet product stored within the dispenser. In some sheet product dispensers, a roll of sheet product is used. A roll of sheet product generally may include a web of sheet product that is wrapped around an axis such that numerous layers of the sheet product are wound around one another. The sheet product may be dispensed by manually or automatically rotating the roll to unwind a portion of the sheet product from the roll and then separating the desired portion from a remainder of the roll. The roll of sheet product may include a central opening extending therethrough along the axis of the roll. Certain rolls of sheet product may be coreless, such that the central opening of the roll is defined by an inner layer of the sheet product. Other rolls of sheet product may be cored, such that the central opening of the roll is defined by a core of paperboard or other material around which the layers of the sheet product are wound. Perforations or cutting arrangements may be used to separate the sheet product for use (e.g., to form a dispensed portion.

BRIEF SUMMARY

In some example embodiments, a sheet product dispenser is provided including a spindle configured to rotatably support a roll of sheet product within the sheet product dispenser. The spindle includes a body configured to be positioned over a mandrel and a set of friction elements disposed at either end of the body. The friction elements provide a contact force against the mandrel, thereby providing a desired resistance to rotation. In some embodiments, the contact force against the mandrel and, therefore, the resistance to rotation of the spindle, is constant irrespective of whether a roll of sheet product is installed on the spindle. Additionally, since the contact force is provided by engagement of the sets of friction elements with the mandrel, the contact force does not rely on a compressive force of a center opening or core of a roll of sheet product. As such, the contact force applied to the mandrel is also constant irrespective of any inconsistencies of an inner surface of the roll of sheet product or core. This configuration may provide a consistent resistance to rotation at a desired (e.g., pre-set) level, thereby preventing over spin while enabling dispensing of the sheet product without premature tearing or separation of perforations. Such benefits may provide a better user experience and/or help maintain efficient usage of the sheet product (avoiding unnecessary extra sheet product from being taken).

In some embodiments, the spindle may include two or more fins extending from the spindle body configured to engage the inner surface of a roll of sheet product. The engagement of the fins and the inner surface, may cause the roll of sheet product to rotate with the spindle about the mandrel, such that the resistance to rotation is transferred from the spindle to the roll of sheet product. In an example embodiment, the mandrel may also include a nose disposed opposite a fixed end. The nose may define a lip with a larger diameter than the body of the mandrel. The lip may be configured to retain the spindle on the body of the mandrel.

In an example embodiment, the inner diameter of the spindle and outer diameter of the mandrel may be larger at a first side than at a second side. The outer diameter of the mandrel may decrease linearly or include one or more step decreases between the first end and the second end. This taper of the inner diameter of the spindle and the outer diameter of the mandrel may enable installation of the spindle onto the mandrel and the desired contact force at each end. The contact forces applied by the first set of friction elements at the first end of the mandrel may be substantially the same as the contact forces applied by the second set of friction elements at the second end. The contact forces being substantially the same on each end of the spindle and mandrel may, in turn, cause a substantially the same resistance to rotation at each end, thereby enabling a balanced rotation of the spindle about the mandrel.

In an example embodiment, a sheet product dispenser is provided. The sheet product dispenser comprises a housing defining a space for receiving at least one roll of sheet product therein. The sheet product dispenser comprises a mandrel positioned within the housing. The mandrel defines a body with a first end and a second end. The sheet product dispenser includes a spindle for supporting a roll of sheet product with respect to the sheet product dispenser. The spindle comprises a spindle body configured to be positioned over the mandrel. The spindle body extends along a longitudinal axis of the spindle from a first end to a second end. The spindle body is configured to be received at least partially within a central opening of the roll of sheet product. The spindle comprises a first set of friction elements extending away from the first end of the spindle body in a first direction that is parallel to the longitudinal axis of the spindle. Each friction element within the first set of friction elements is separated from an adjacent friction element by at least one slot and is configured to extend radially inward from the spindle body so as to provide a contact force against the first end of the mandrel when the spindle is installed on the mandrel. The spindle further includes a second set of friction elements extending away from the second end of the spindle body in a second direction that is parallel to the longitudinal axis of the spindle. Each friction element within the second set of friction elements is separated from an adjacent friction element by at least one slot and is configured to extend radially inward from the spindle body so as to provide a contact force against the second end of the mandrel when the spindle is installed on the mandrel. The contact force against the first end of the mandrel and the contact force against the second end of the mandrel are constant irrespective of whether the roll of sheet product is installed on the spindle.

In some embodiments, an inner diameter of the spindle body at the first end defined by the first set of friction elements is larger than an inner diameter of the spindle body at the second end defined by the second set of friction elements. In some embodiments, the inner diameter of the spindle body changes linearly from the first end to the second end.

In some embodiments, the spindle further comprises at least two fins extending radially outward from the spindle body and configured to engage an inner surface corresponding to the central opening of the roll of sheet product such that the spindle rotates with the roll of sheet product.

In some embodiments, the contact force against the first end of the mandrel as applied by the first set of friction elements is configured to cause substantially the same resistance to rotation about the mandrel as the contact force against the second end of the mandrel as applied by the second set of frictions elements.

In some embodiments, a center portion of the spindle body disposed between the first set of friction elements and the second set of friction elements is configured to be spaced from and rotate about the mandrel at a predetermined distance away from an outer circumference of the mandrel when the spindle is installed on the mandrel.

In some embodiments, when installed on the mandrel, the spindle is configured to rotate about the body of the mandrel while exerting a friction force based on the contact force from the first set of friction elements on the first end of the mandrel and the contact force from the second set of friction elements on the second end of the mandrel.

In some embodiments, an outer diameter of the first end of the body of the mandrel is larger than an outer diameter of the second end of the body of the mandrel. In some embodiments, the outer diameter of the body of the mandrel decreases linearly from the first end to the second end. In some embodiments, the outer diameter of the body of the mandrel comprises at least one step decrease between the first end and the second end.

In some embodiments, the body of the mandrel defines a circular-shaped cross section or a cross-shaped cross section.

In some embodiments, the body of the mandrel is fixedly attached to a support at the first end, wherein the mandrel further comprises a nose disposed proximate the second end of the body of the mandrel. In some embodiments, the nose defines a lip having a larger outer diameter than the body of the mandrel. When the spindle is installed on the mandrel, the lip is configured to engage the second set of friction elements to retain the spindle in a predetermined position on the mandrel.

In some embodiments, the sheet product dispenser further comprises a second mandrel positioned within the housing. The second mandrel defines a body with a first end and a second end. The sheet product dispenser further includes a second spindle for supporting a second roll of sheet product with respect to the sheet product dispenser. The second spindle comprises a spindle body configured to be positioned over the second mandrel. The spindle body extends along a longitudinal axis of the second spindle from a first end to a second end. The spindle body is configured to be received at least partially within a central opening of the second roll of sheet product. The second spindle further includes a first set of friction elements extending away from the first end of the spindle body in a first direction that is parallel to the longitudinal axis of the second spindle. Each friction element within the first set of friction elements is separated from an adjacent friction element by at least one slot and configured to extend radially inward from the spindle body so as to provide a contact force against the first end of the second mandrel when the second spindle is installed on the second mandrel. The second spindle further includes a second set of friction elements extending away from the second end of the spindle body in a second direction that is parallel to the longitudinal axis of the second spindle. Each friction element within the second set of friction elements is separated from an adjacent friction element by at least one slot and is configured to extend radially inward from the spindle body so as to provide a contact force against the second end of the second mandrel when the second spindle is installed on the second mandrel. The contact force against the first end of the second mandrel and the contact force against the second end of the second mandrel are constant irrespective of whether the second roll of sheet product is installed on the second spindle.

In some embodiments, the spindle body is configured to engage an inner surface corresponding to the central opening of the roll of sheet product when the roll of sheet product is installed on the spindle. The contact force against the first end of the mandrel and the contact force against the second end of the mandrel are constant irrespective of any inconsistencies of the inner surface corresponding to the central opening of the roll of sheet product.

In another example embodiment, an assembly for supporting a roll of sheet product with respect to a sheet product dispenser is provided. The assembly comprises a mandrel configured to be positioned within a housing of the sheet product dispenser. The mandrel defines a body with a first end and a second end. The assembly further includes a spindle for supporting a roll of sheet product with respect to the sheet product dispenser. The spindle comprises a spindle body configured to be positioned over the mandrel. The spindle body extends along a longitudinal axis of the spindle from a first end to a second end. The spindle body is configured to be received at least partially within a central opening of the roll of sheet product. The spindle further comprises a first set of friction elements extending away from the first end of the spindle body in a first direction that is parallel to the longitudinal axis of the spindle. Each friction element within the first set of friction elements is separated from an adjacent friction element by at least one slot and is configured to extend radially inward from the spindle body so as to provide a contact force against the first end of the mandrel when the spindle is installed on the mandrel. The spindle further includes a second set of friction elements extending away from the second end of the spindle body in a second direction that is parallel to the longitudinal axis of the spindle. Each friction element within the second set of friction elements is separated from an adjacent friction element by at least one slot and is configured to extend radially inward from the spindle body so as to provide a contact force against the second end of the mandrel when the spindle is installed on the mandrel. The contact force against the first end of the mandrel and the contact force against the second end of the mandrel are constant irrespective of whether the roll of sheet product is installed on the spindle.

In some embodiments, the spindle body is configured to engage an inner surface corresponding to the central opening of the roll of sheet product when the roll of sheet product is installed on the spindle. The contact force against the first end of the mandrel and the contact force against the second end of the mandrel are constant irrespective of any inconsistencies of the inner surface corresponding to the central opening of the roll of sheet product.

In some embodiments, the contact force against the first end of the mandrel as applied by the first set of friction elements is configured to cause substantially the same resistance to rotation about the mandrel as the contact force against the second end of the mandrel as applied by the second set of frictions elements.

In yet another example embodiment, a spindle for supporting a roll of sheet product with respect to a sheet product dispenser is provided. The spindle comprises a spindle body configured to be positioned over a mandrel, wherein the mandrel defines a body with a first end and a second end. The spindle body extends along a longitudinal axis of the spindle from a first end to a second end. The spindle body is configured to be received at least partially within a central opening of the roll of sheet product. The spindle further includes a first set of friction elements extending away from the first end of the spindle body in a first direction that is parallel to the longitudinal axis of the spindle. Each friction element within the first set of friction elements is separated from an adjacent friction element by at least one slot and configured to extend radially inward from the spindle body so as to provide a contact force against the first end of the mandrel when the spindle is installed on the mandrel. The spindle further includes a second set of friction elements extending away from the second end of the spindle body in a second direction that is parallel to the longitudinal axis of the spindle. Each friction element within the second set of friction elements is separated from an adjacent friction element by at least one slot and is configured to extend radially inward from the spindle body so as to provide a contact force against the second end of the mandrel when the spindle is installed on the mandrel. The contact force against the first end of the mandrel and the contact force against the second end of the mandrel are constant irrespective of whether the roll of sheet product is installed on the spindle.

In some embodiments, the spindle body is configured to engage an inner surface corresponding to the central opening of the roll of sheet product when the roll of sheet product is installed on the spindle. The contact force against the first end of the mandrel and the contact force against the second end of the mandrel are constant irrespective of any inconsistencies of the inner surface corresponding to the central opening of the roll of sheet product.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 10:
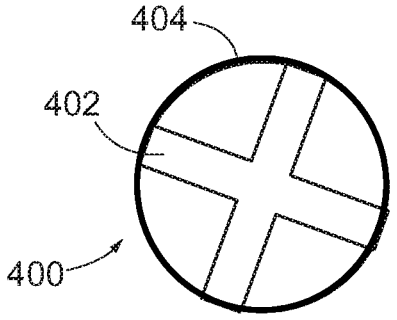
FIG. 10 shows an illustration of a cross-section of an example mandrel, in accordance with some embodiments discussed herein.
Figure 11:
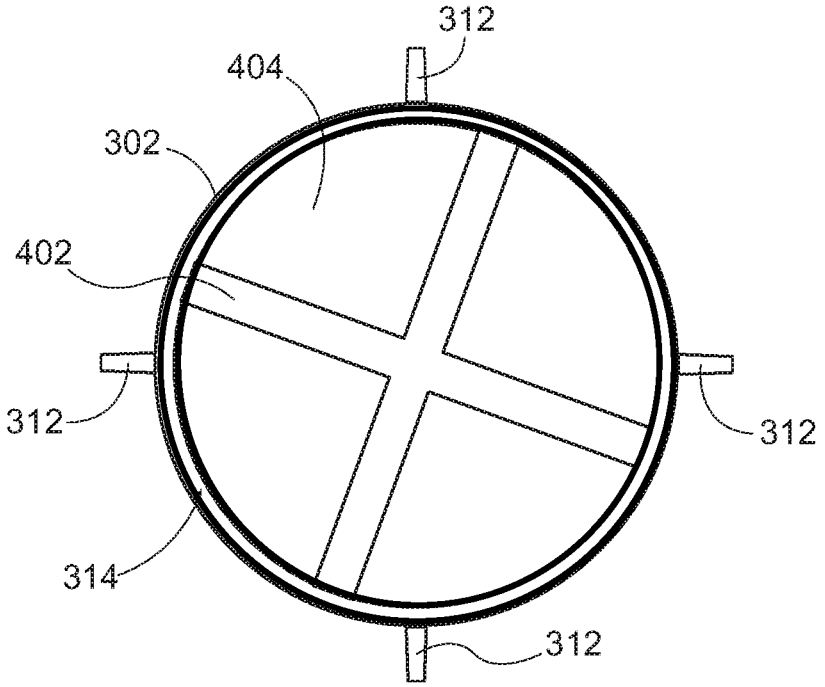
Figure 12:
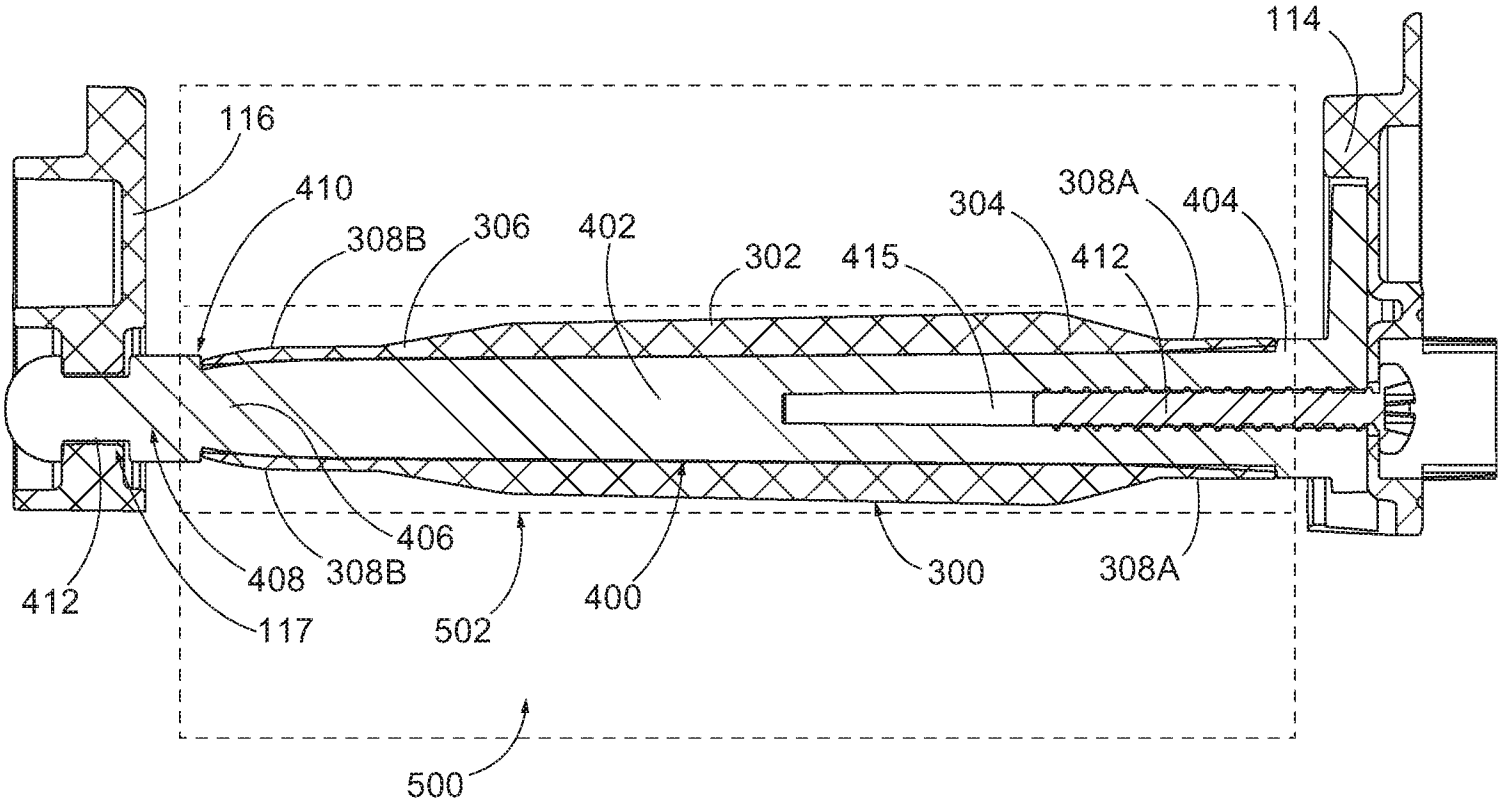

FIG. 11 shows an illustration of a cross-section of an example spindle cross-section that is installed on the mandrel cross-section shown in FIG. 10, in accordance with some embodiments discussed herein; and FIG. 12 illustrates a longitudinal cross-sectional view of a spindle disposed on a mandrel, wherein an example roll of sheet product is shown in dotted line as installed on the spindle, in accordance with some embodiments discussed herein.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout.

As used herein, a "user" of example sheet product dispensers may be a maintainer (e.g., a maintenance person, a janitor, a facility manager, etc.) or a consumer (e.g., a person retrieving a dispensed portion of the product).

As used herein, the term "sheet product" may include a product that is relatively thin in comparison to its length and width. Further, the sheet product may define a relatively flat, planar configuration. In some embodiments, the sheet product is flexible or bendable to permit, for example, folding, rolling, stacking, or the like. In this regard, sheet product may, in some cases, be formed into stacks or rolls for use with various embodiments described herein. Some example sheet products include towel, bath tissue, facial tissue, napkin, wipe, wrapping paper, aluminum foil, wax paper, plastic wrap, or other sheet-like products. Sheet products may be made from paper, cloth, non-woven, metallic, polymer or other materials, and in some cases may include multiple layers or plies. In some embodiments, the sheet product (such as in roll or stacked form) may be a continuous sheet that is severable or separable into individual sheets using, for example, a tear bar or cutting blade. Additionally or alternatively, the sheet product may include predefined areas of weakness, such as lines of perforations, that define individual sheets and facilitate separation and/or tearing. In some such embodiments, the lines of perforations may extend along the width of the sheet product to define individual sheets that can be torn off by a user.

As used herein, the term "roll of sheet product" refers to a sheet product formed in a roll, such as by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

In various sheet product dispenser configurations, the central opening of a roll of sheet product may be used in conjunction with a spindle and/or mandrel (or similar structure) to rotatably support the roll with respect to the sheet product dispenser. For example, a spindle, a mandrel, or other type of support of the sheet product dispenser may be positioned at least partially within the central opening of the roll of sheet product (e.g., cored or coreless) and allow the roll of sheet product to rotate with respect to the sheet product dispenser.

Some example sheet product dispensers may include a mandrel to support a roll of sheet product. The central opening of the roll may be inserted over the mandrel such that the roll of sheet product may rotate about the mandrel. Other example sheet product dispensers may include a spindle designed to engage and cooperate with either an inner layer of the sheet product (for coreless rolls of sheet product) or a paperboard core (for cored rolls of sheet product). The spindle is, in turn, configured to rotate about the mandrel.

As the roll of sheet product rotates, there may be a resistance to rotation that may affect the amount and rate of dispensing of the sheet product. For example, little or no resistance to rotation may cause the sheet product to dispense quickly when pulled, which may result in an excessive amount of sheet product being dispensed. Additionally or alternatively, little or no resistance to rotation may cause over spin of the roll of sheet product. Over spin may cause a free end of the sheet product to travel back into the dispenser, which may cause an unsatisfactory user experience if a user has to locate the free end or manually rotate the roll of sheet product to free the free end of the sheet product. Such a situation may also be undesirable from a sanitary concern, as it is generally desirable to avoid or limit touching of the roll of sheet product. Further, over spin may cause jamming of the roll of sheet product in the sheet product dispenser. If, however, the resistance to rotation is relatively high, the sheet product may tear or separate at a perforation prematurely.

Some example sheet product dispensers may include one or more mechanisms to induce a desired resistance to rotation, such as by interaction between a housing component and the outer circumference of the roll of sheet product or by interaction between a portion of the spindle or mandrel and an inner surface corresponding to the central opening of the roll of sheet product. However, these mechanisms may rely on the inner or outer circumference of the roll of sheet product or the inner surface corresponding to the central opening of the roll of sheet product, each of which may be variable due to manufacture, storage, or other events. These variations may, in turn, cause inconstant resistance to rotation, which may detract from the user experience.

As described herein, a sheet product dispenser is provided including at least one spindle assembly. The spindle includes a body configured to be positioned over a mandrel and a set of friction elements disposed at either end of the body. The friction elements provide a contact force against the mandrel, thereby providing a desired resistance to rotation. The contact force against the mandrel and, therefore, the resistance to rotation of the spindle, is constant irrespective of whether a roll of sheet product is being installed on the spindle. Additionally, since the contact force is provided by engagement of the sets of friction elements with the mandrel, the contact force does not rely on a compressive force of a central opening or core of a roll of sheet product. As such, the contact forces applied to the mandrel are also constant irrespective of any inconsistencies of an inner surface of the roll of sheet product or core. This configuration may provide a consistent resistance to rotation at the desired level, thereby preventing unnecessary extra dispensing and/or over spin while enabling dispensing of the sheet product without premature tearing or separation of perforations.

Figure 1:
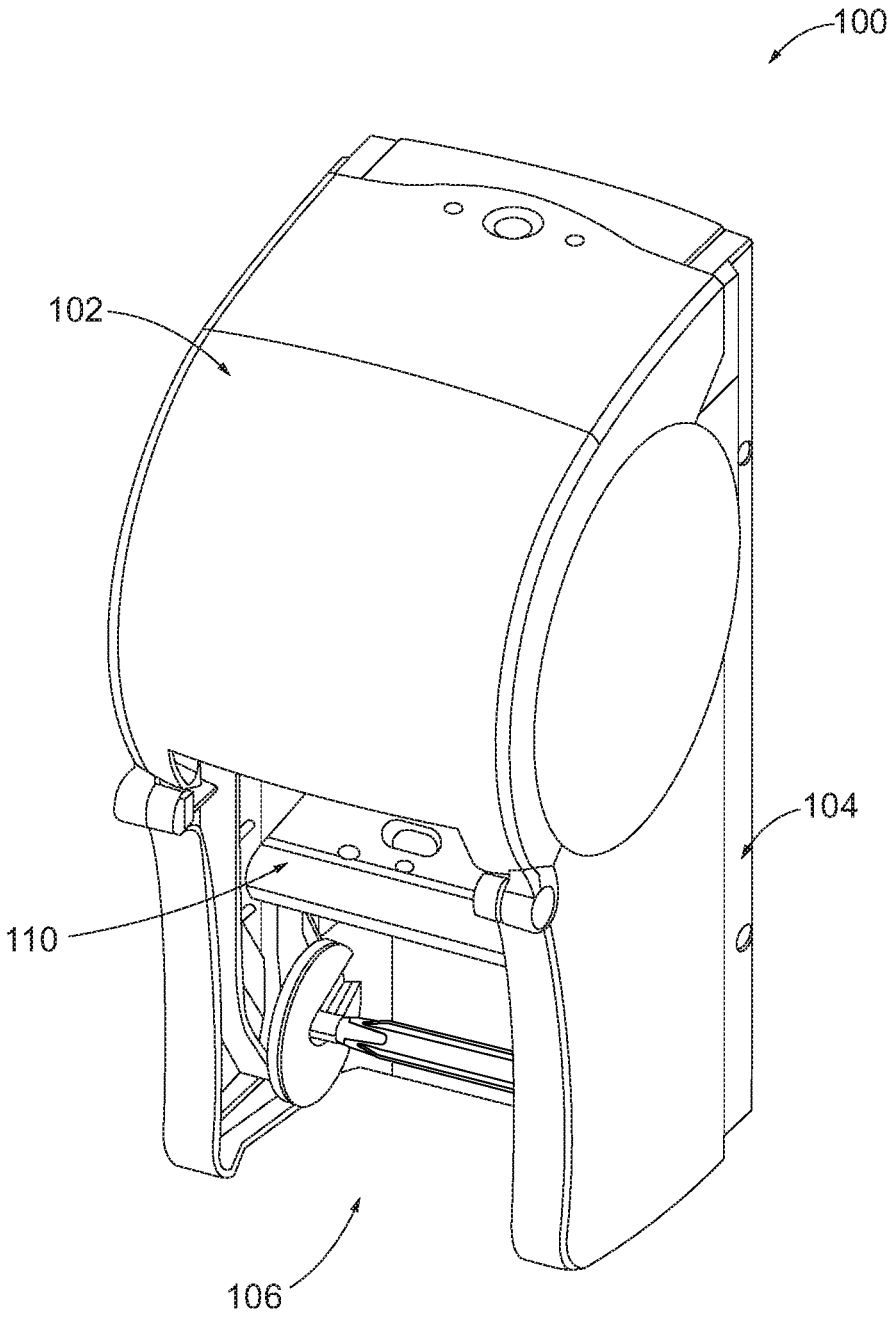
FIG. 1 illustrates a perspective view of an example sheet product dispenser, in accordance with some embodiments discussed herein.
Figure 2:
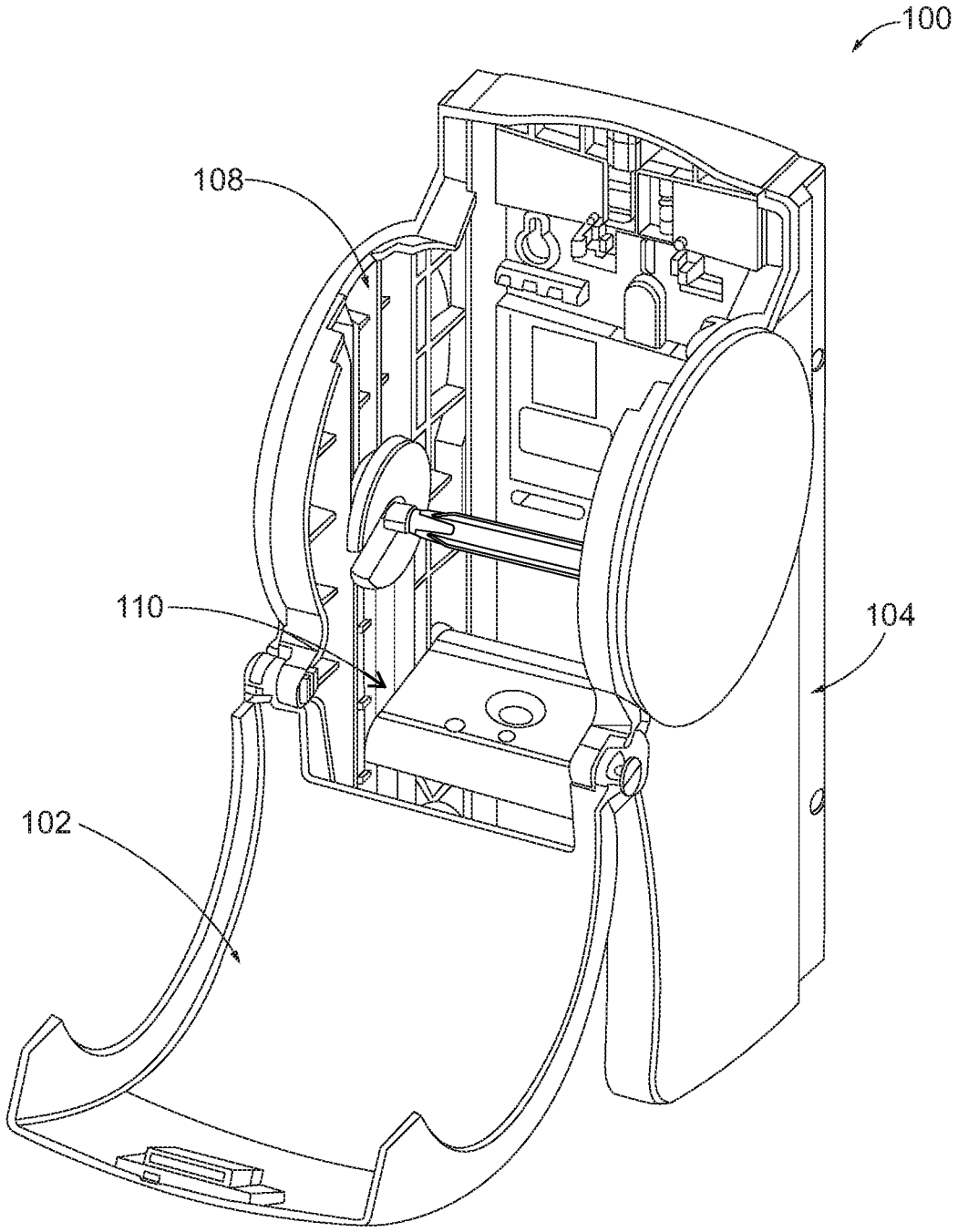
FIG. 2 illustrates a perspective view of the sheet product dispenser of FIG. 1, wherein the housing is shown in an open configuration, in accordance with some embodiments discussed herein.
Figure 3:
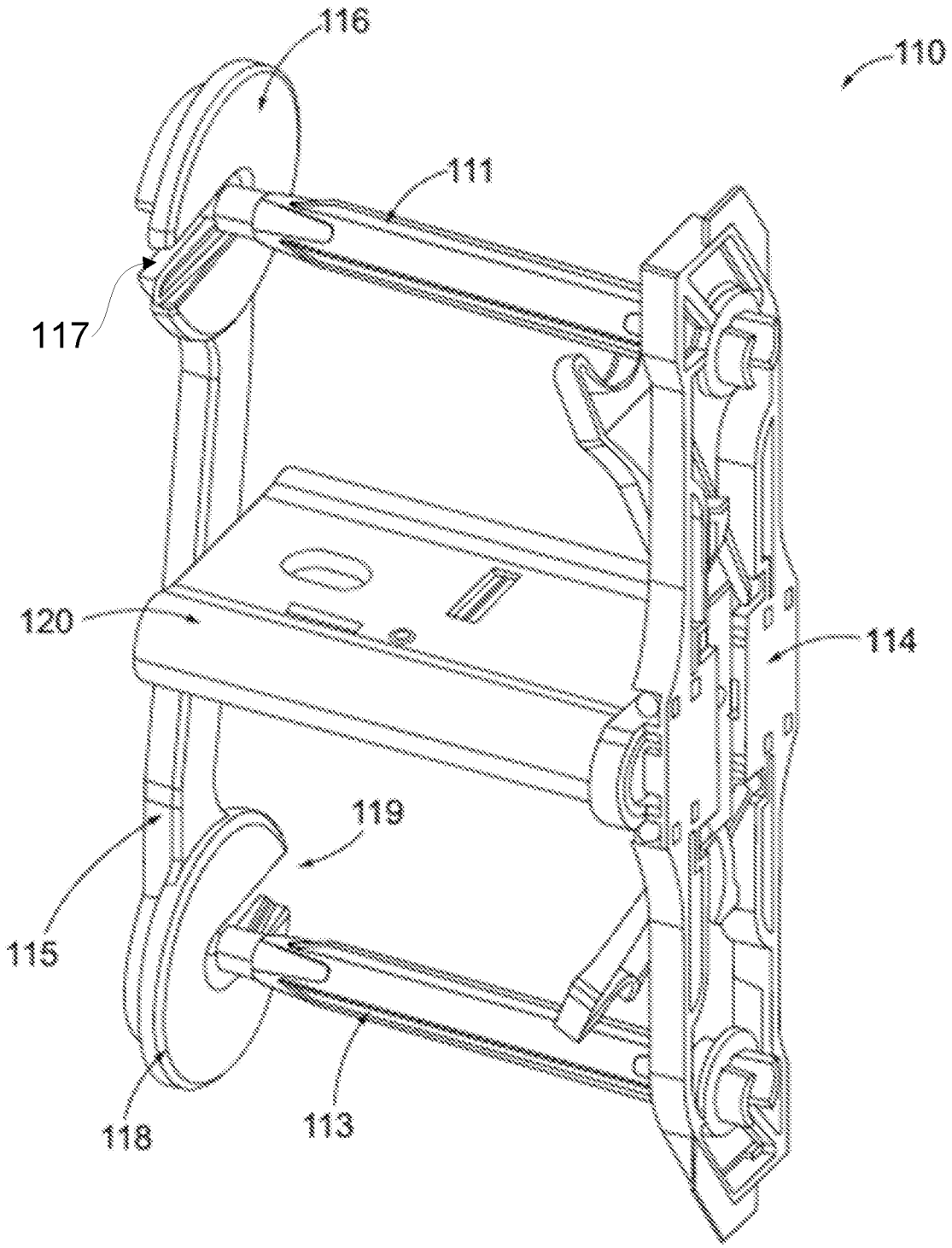
FIG. 3 illustrates a perspective view of a holding mechanism of a sheet product dispenser including a pair of spindles, in accordance with some embodiments discussed herein.

In some embodiments, sheet product dispensers include one or more spindle assemblies for supporting one or more rolls of sheet product therein. For example, FIGS. 1-3 illustrate an example sheet product dispenser that is a manual tissue dispenser 100. The dispenser 100 includes a housing defining an interior space for receiving one or more rolls of sheet product. The housing is defined by a cover 102 and a base portion 104. The base portion 104 may be configured for attachment to a wall or other support structure for mounting the sheet product dispenser 100 thereto. One or more rolls are held by a holding mechanism 110 (shown in more detail in FIG. 3). At least one roll is accessible by a user through a dispensing opening 106 in the housing. In this regard, a user may access the roll and remove (e.g., tear off) a portion thereof for use. Such removal may be facilitated by one or more perforations in the sheet product. Additionally or alternatively, though not shown in the example sheet product dispenser, removal of a portion of the sheet product may be facilitated by a cutting mechanism disposed on the sheet product dispenser (e.g., proximate the dispensing opening).

With reference to FIG. 2, the holding mechanism 110 may be removed from the housing when the cover 102 is in the open position. In the depicted embodiment, the holding mechanism 110 may be manually moved along a track 108 such that the holding mechanism 110 is completely removed from within the housing (such as shown in FIG. 3).

With reference to FIG. 3, the holding mechanism may include a support 114, a center portion 120, and a rotatable arm 115. A first spindle assembly 111 may extend from the support 114 and be received in a first slot 117 of a first end 116 of the rotatable arm 115. The first spindle assembly 111 may include a spindle and a mandrel that are configured to hold/receive a first roll of sheet product (such as described herein). A second spindle assembly 113 may extend from the support 114 and be received in a second slot 119 of a second end 118 of the rotatable arm 115. The second spindle assembly 113 may include a spindle and a mandrel that are configured to hold/receive a second roll of sheet product. The center portion 120 may be configured to house one or more sensors or other features/components related to the sheet product dispenser. For example, a product level sensor could be housed within the center portion and aimed toward a product roll (e.g., an infrared sensor, time-of-flight sensor, etc.). More information regarding some example sensors for a sheet product dispenser can be found in U.S. patent application Ser. No. 15/971,393, entitled "Sheet Product Level Sensor Calibration and Indication Systems and Methods", filed on May 4, 2018, which is assigned to the assignee of the present application and incorporated by reference in its entirety.

Figure 4:
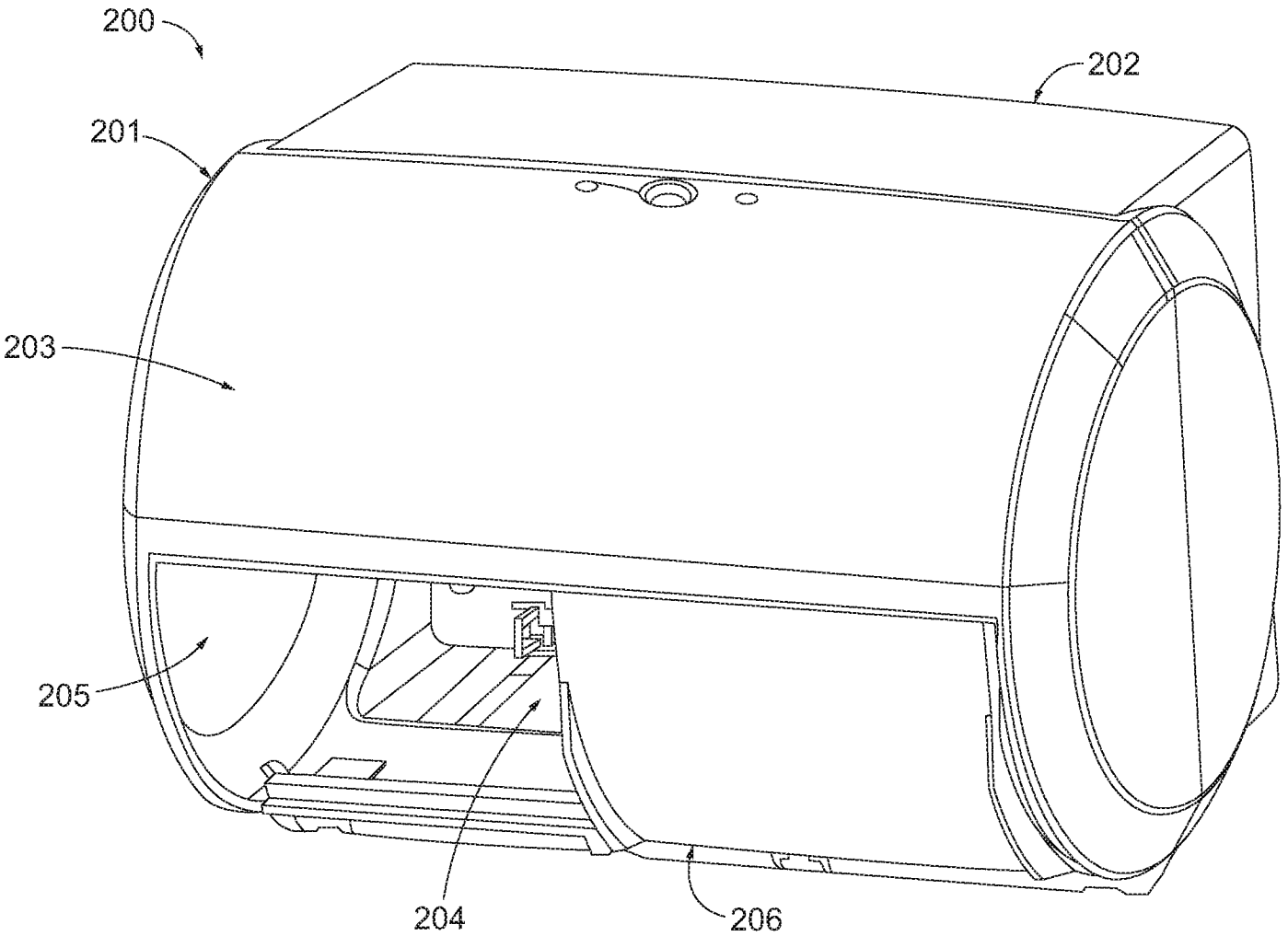
FIG. 4 illustrates a perspective view of an example side-by-side sheet product dispenser, in accordance with some embodiments discussed herein.
Figure 5:
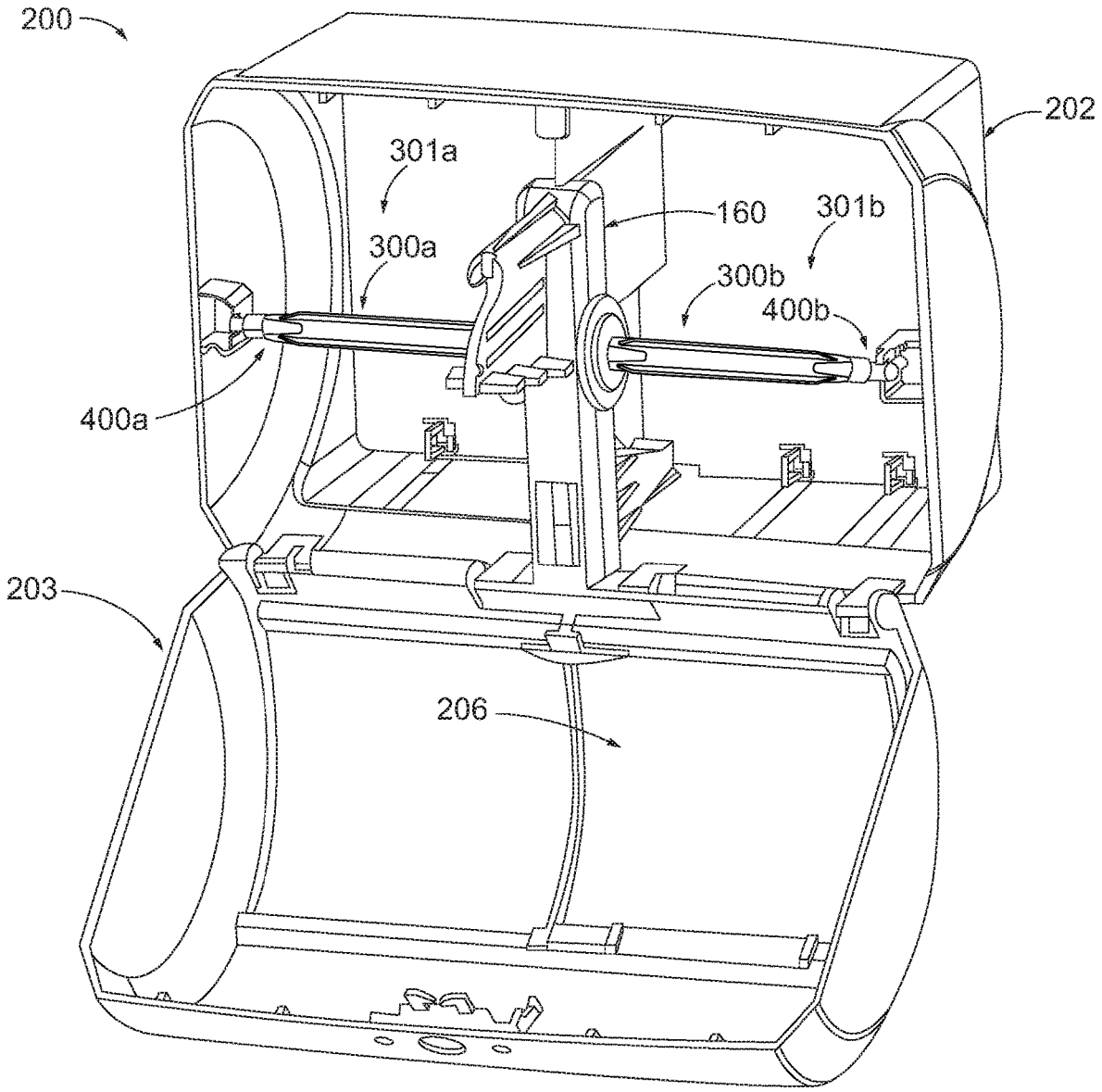
FIG. 5 illustrates a perspective view of the sheet product dispenser of FIG. 4, wherein the housing is shown in an open configuration, in accordance with some embodiments discussed herein.

FIGS. 4 and 5 illustrate another example sheet product dispenser 200. As shown, the sheet product dispenser 200 may include a pair of spindle assemblies 301 for supporting a pair of rolls of sheet products. Although the illustrated embodiment includes two spindle assemblies 301 arranged in a side-by-side configuration, other embodiments of the dispenser 200 may include three, four, five, or more spindle assemblies 301 arranged in a stacked configuration, a carousel configuration, or other manner. The sheet product dispenser 200 may include a housing 201 configured to receive the rolls entirely or at least partially therein. As shown, the housing 201 may include a first housing portion 202 (which also may be referred to as a "back portion" or a "base portion") configured to attach to a wall or other support structure for mounting the sheet product dispenser 200 thereto. The housing 201 also may include a second housing portion 203 (which also may be referred to as a "cover portion") movably attached to the first housing portion 202 and configured to move between a closed position for dispensing sheet product (shown in FIG. 4) and an open position for loading one or more rolls (shown in FIG. 5). In some embodiments, as shown, the second housing portion 203 may be configured to pivot relative to the first housing portion 202 to move the housing 201 between the closed position and the open position.

When the second housing portion 203 is in the closed position, the housing 201 may define an interior space 204 configured to receive the rolls at least partially therein. In particular, a first roll may be positioned on a first spindle 300*a* of the first spindle assembly 301*a* within a first portion of the interior space 204, and a second roll may be positioned on a second spindle 300*b* of the second spindle assembly 301*b* within a second portion of the interior space 204. As shown, the first spindle 300*a* may be mounted on a first mandrel 400*a* extending from a support 160. Additionally, the second spindle 300*b* may be mounted on a second mandrel 400*b* extending from the support 160. The mandrels 400*a*, 400*b* may be fixedly attached to the support 160 at their respective first ends. The spindles 300*a*, 300*b*, the mandrels 400*a*, 400*b*, and the support 160 may be configured in the manner described below in reference to FIGS. 6-12.

In some embodiments, the support 160 may be configured to move, such as by pivoting, relative to the first housing portion 202 between a first position for dispensing sheet product and a second position for loading one or more rolls onto the spindles 300*a*, 300*b*. As shown, the second housing portion 203 may include a dispenser opening 205 defined therein, and a door 206 movably positioned within the dispenser opening 205. For example, the door 206 may be slidably positioned within the dispenser opening 205 and configured to slide between a first position in which the door 206 covers the second portion of the interior space 204 and the second roll (if present) positioned therein, as shown in FIG. 4, and a second position in which the door 206 covers the first portion of the interior space 204 and the first roll (if present) positioned therein. In this manner, a user may access and dispense (e.g., retrieve) sheet product from the first roll when the door 206 is in the first position, and the user may access and dispense sheet product from the second roll when the door 206 is in the second position. In particular, the user may grasp and pull a tail portion of the respective roll extending through the open portion of the dispensing opening 205 (i.e., the portion that is not blocked by the door 206) to dispense sheet product.

Figure 6:
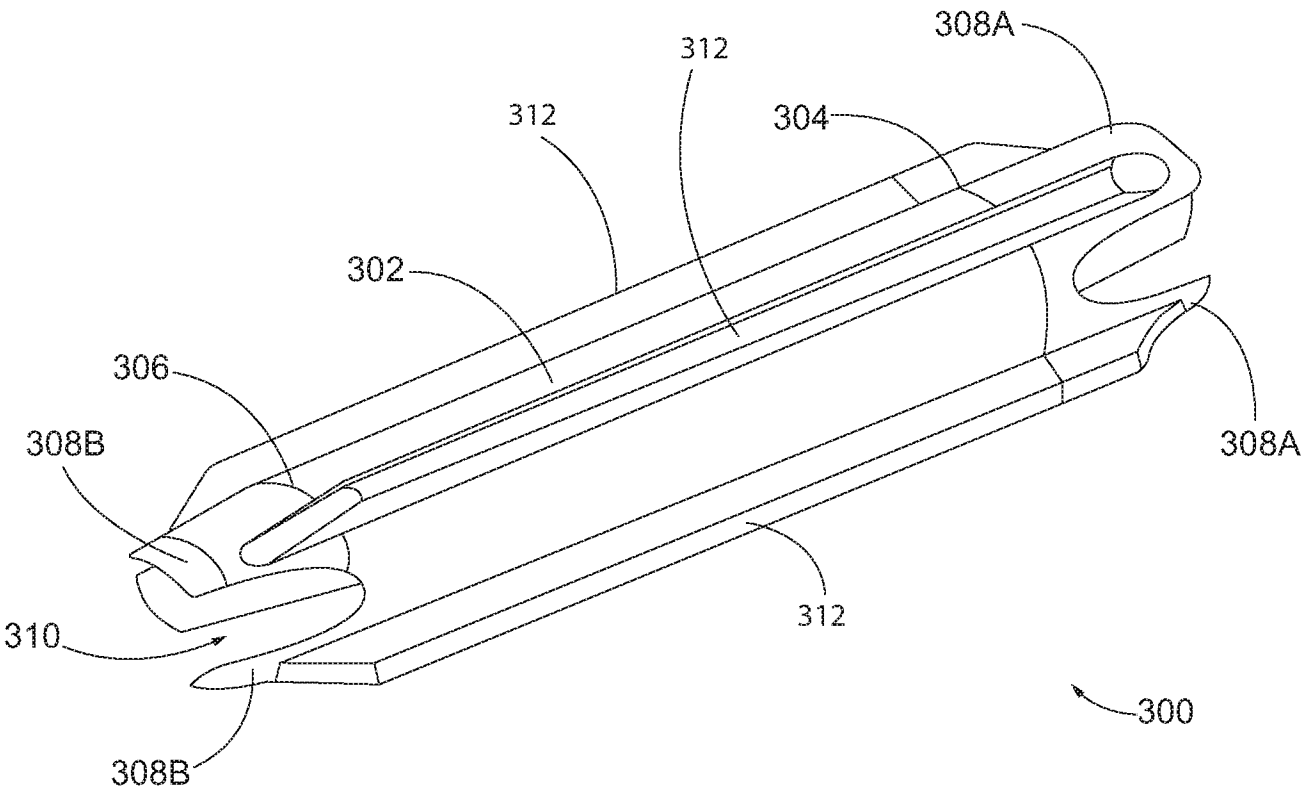
FIG. 6 illustrates a perspective view of an example spindle, in accordance with some embodiments discussed herein.
Figure 7:
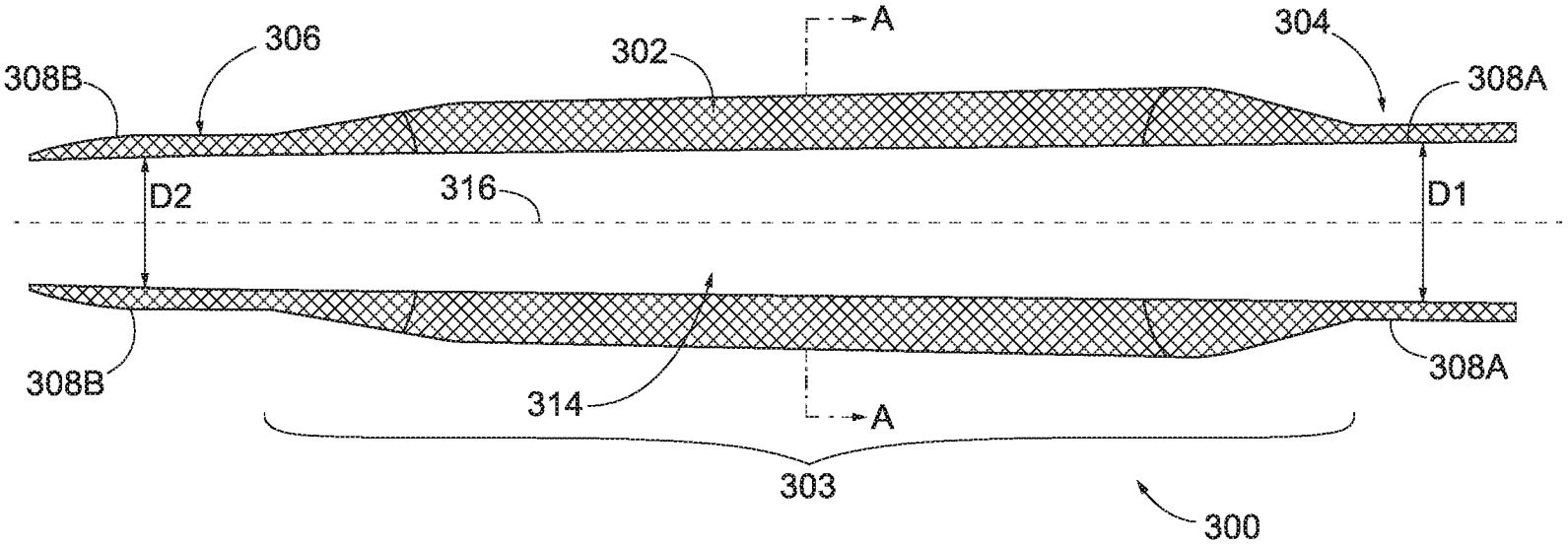
FIG. 7 illustrates a longitudinal cross-sectional view of a spindle, in accordance with some embodiments discussed herein.

FIGS. 6-12 illustrate various example spindle assemblies for rotatably supporting a roll of sheet product including a spindle 300 and a mandrel 400. FIG. 6 illustrates a perspective view of an example spindle 300, while FIG. 7 illustrates a longitudinal cross-section view of the example spindle 300. The spindle 300 includes a spindle body 302 extending along a longitudinal axis 316 from a first end 304 to a second end 306. The spindle 300 may have a generally tubular shape and be formed from plastic, metal, or other suitable material. The example spindle 300 includes a set of friction elements 308A, 308B at each end of the spindle body 302. A first set of friction elements 308A extends outwardly away from the first end 304 of the spindle body 302 in a first direction that is parallel to the longitudinal axis 316. A second set of friction elements 308B extends outwardly away from the second end 306 of the spindle body 302 in a second, opposite direction that is parallel to the longitudinal axis 316.

Adjacent friction elements of each set of friction elements 308A, 308B are separated by a slot 310. In some embodiments, separation of the adjacent friction elements may enable some flexibility for deflection of each friction element, such as may occur during installation of the spindle 300 on the mandrel (such as described in further detail herein). The friction elements 308A, 308B also extend radially inward toward the longitudinal axis 316 of the spindle 300. This inward extension provides a contact force against the mandrel 400 (see e.g., FIGS. 8A and 8B), when installed thereon, as described below in reference to FIG. 12.

The spindle 300 may be configured for use with cored and/or coreless rolls of sheet product. During use of the spindle 300, the spindle body 302 may be positioned at least partially within the central opening of the roll of sheet product. In this regard, in some embodiments, the outer circumference of the spindle body 302 is configured to engage the inner surface of the roll of sheet product, such that the spindle 300 and roll rotate together about the mandrel 400. In an example embodiment, the spindle 300 may include one or more fins 312 attached to the spindle body 302 and extending radially outward therefrom. In some embodiments, the spindle body 302 may include a pair of the fins 312 circumferentially spaced apart from one another, for example, by 180 degrees, although any number of the fins 312 and alternative spacing of the fins 312 may be used. Each fin 312 may be formed as an elongated member extending in the direction of the longitudinal axis 316. In some embodiments, such as shown in FIG. 6, each fin 312 may have a trapezoidal cross-sectional shape taken in a plane including the longitudinal axis 316, although other shapes may be used. Each fin 312 may have a fixed edge that is fixedly attached to the spindle body 302 and an opposite free edge. The free edge may be configured to frictionally engage the inner surface of the central opening of the roll of sheet product, such that the spindle and the roll rotate with one another about the mandrel 400 of the sheet product dispenser.

Figure 8A:
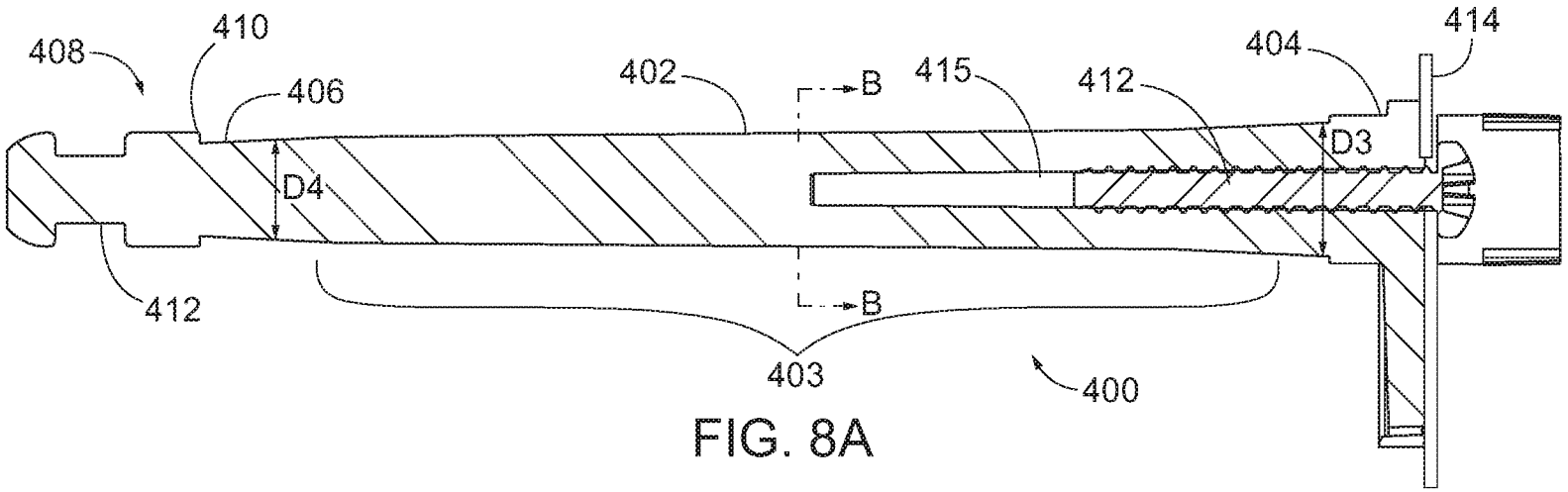
FIGS. 8A and 8B illustrate longitudinal cross-sectional views of example mandrels, in accordance with some embodiments discussed herein.
Figure 8B:
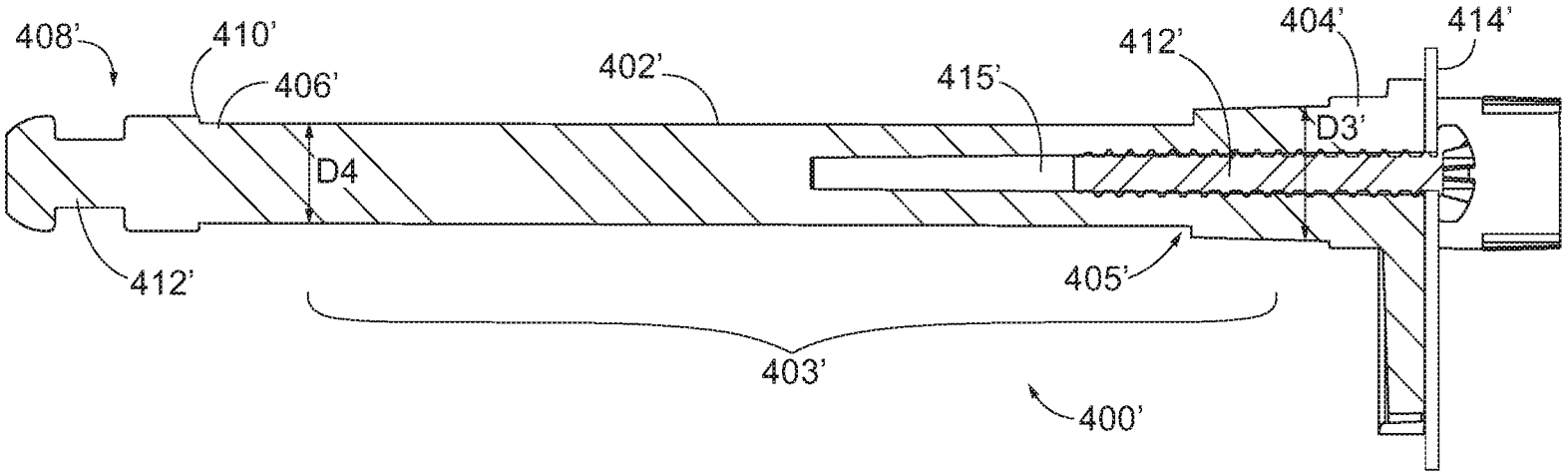

The spindle body 302 includes an aperture 314 extending longitudinally therethrough and configured to receive at least a portion of the mandrel 400 (shown in FIGS. 8A and 8B). The inner diameter D1 of the spindle body 302 at the first end 304 may be larger than the inner diameter D2 of the spindle body at the second end 306. The decrease in inner diameter from the first end 304 to the second end 306 may be linear (or other function) or may include one or more step decreases from the first end 304 to the second end 306. The difference in the inner diameter of the aperture 314 may enable installation of the spindle 300 onto the mandrel 400, as discussed in further detail below in reference to FIG. 12.

FIGS. 8A and 8B illustrate longitudinal cross-sectional views of two example mandrels 400, 400' according to example embodiments. The mandrel 400 of FIG. 8A has a tapered body 402 causing an increasing cross-sectional area of the body moving from left to right, whereas the mandrel 400' of FIG. 8B includes a step 405' increase in the cross-sectional area of the body 402'. The mandrel 400 shown in FIG. 8A may include a body 402 extending longitudinally from a first end 404 to a second end 406. The mandrel 400 may be fixedly attached to the support 414 at the first end 404. For example, the first end may be integral to the support 414 or may be press fit, or interference fit, into the support 414. Additionally or alternatively, the first end 404 of the mandrel, as depicted in FIGS. 8A and 8B, may include a fastener 412 configured to pass through a portion of the support 414 into a fastener aperture 415 disposed in the first end 404, thereby operably coupling the first end 404 to the support 414.

The mandrel 400 may also include a nose 408 disposed proximate the second end 406 of the mandrel 400. The nose 408 may define a lip 410 having a larger outer diameter than the body 402 of the mandrel 400 proximate the lip 410. The lip 410 may be configured to engage the second set of friction elements 308B to retain the spindle 300 in a predetermined position, e.g. on the body 402 of the mandrel 400, when the spindle 300 is installed on the mandrel 401 (shown in FIG. 12). The nose 408 may also include a slot groove 412 configured to be received within a slot, such as the slot 117, 119 disposed in the first end 116 or second end 118 of the rotatable arm 115, as depicted in FIG. 3.

The body 402 of the mandrel 400 may have an outer diameter D3 at the first end 404 that is larger than the outer diameter D4 at the second end 406. The change in the outer diameter of the body 402 of the mandrel 400 from the first end 404 to the second end 406 may be complementary to the change in inner diameter of the aperture 314 of the spindle body 302. As depicted in FIG. 8A the change in outer diameter of the body 402 of the mandrel 400 decreases linearly from the first end 404 to the second end 406. In a different example, as depicted in FIG. 8B, the outer diameter of the body 402' of the mandrel 400' includes one or more step decreases 405' from the first end 404' to the second end 406'.

Figure 9:
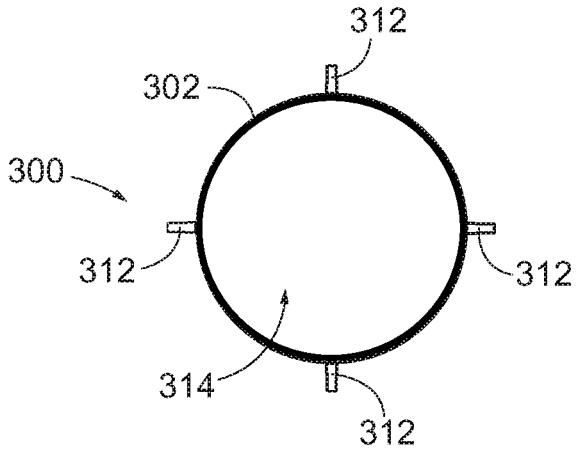
FIG. 9 shows an illustration of a cross-section of an example spindle, in accordance with some example embodiments.

FIG. 9 shows an illustration of a cross-section of the spindle 300 at cross-section A-A of FIG. 7. Notably, FIG. 9 does not show further portions of the spindle 300 beyond the immediate cross-section (e.g., looking down the remainder of the spindle). The depicted spindle body 302 includes four fins 312 disposed at 90 degrees and a tubular aperture 314 disposed longitudinally therethrough. FIG. 10 shows an illustration of a cross-section of the mandrel 400 at cross-section B-B of FIG. 8A. Notably, FIG. 10 does not show further portions of the mandrel 400 beyond the immediate cross-section (e.g., looking down the remainder of the mandrel). The body 402 of the mandrel 400 includes a cross-shaped cross-section, however other shapes may also be used, such as triangular, circular, etc. In some embodiments, despite a central portion of the mandrel 400 having a cross-shaped cross section, portions proximate the first end 404 and the second end 406 (not shown in FIG. 10) have may have a circular cross-section to enable engagement of the friction elements 308 about the entire circumference of each end of the mandrel 400. FIG. 11 shows an illustration of the cross-section of the mandrel 400 of FIG. 10 within the cross-section of the spindle 300 of FIG. 9. In some embodiments, the center portion (303 of FIG. 7) of the spindle body 302, disposed between the first set of friction elements 308A and second set of friction elements 308B, is configured to be spaced from a central portion (403 of FIG. 8A) of the mandrel 400. As depicted in FIG. 11, a predetermined distance is provided between the inner diameter of the center portion 303 of the spindle body 302 and the outer diameter of the center portion 403 of the body 402 of the body of the mandrel 400.

Referring to FIG. 12, the spindle body 302 may be positioned entirely or at least partially within the central opening 502 of a cored or coreless roll of sheet product 500, such that the spindle body 302 supports a respective portion of the roll 500 (the roll of sheet product is shown in dotted line in FIG. 12). In some instances, the outer surface of second end 306 of the spindle body 302 may be tapered to facilitate insertion of the spindle body 302 into the central opening 502 of the roll 500.

The following describes an example installation of the spindle 300 onto mandrel 400. As detailed above with respect to FIG. 7, the spindle body 302 includes aperture 314 extending longitudinally therethrough from the first end 304 to the second end 306. In this manner, the spindle 300 may be mounted on the mandrel 400 of the dispenser, with the mandrel 400 extending through the aperture 314 (such as shown in FIG. 12). As discussed above, the inner diameter of the spindle body 302 may be tapered, or decrease, from the first end 304 to the second end 306, which is complementary to a taper of the body 402 of the mandrel 400. The spindle 300 may be mounted on the mandrel 400 by inserting the nose 408 and second end 406 of the mandrel 400 into the aperture 314 at the first end 304 of the spindle body 302. After the spindle 300 has been moved further onto the body 402 of the mandrel 400, the second set of friction elements 308B approach the nose 408. As the inner diameter of the second set of friction elements 308B engages the nose 408, the second set of friction elements 308B may deflect radially outward, allowing the second set of friction elements 308B to pass over the nose 408 and lip 410. Once the second set of friction elements 308B passes the lip 410, the second set of friction elements 308B may retract radially inward toward the body 402 of the mandrel 400 (such as due to the bias of the material of the second set of friction elements 308B). In that position, the lip 410 may engage the second set of friction elements 308B to retain the spindle 300 on the body 402 of the mandrel 400.

In some embodiments, the inner diameters of the first set of friction elements 308A and the second set of friction elements 308B of the spindle 300 and the outer diameters of the first end 404 and second end 406 of the mandrel 400 may be designed so as to cause predetermined contact forces on the mandrel 400 when the spindle 300 is installed. In this regard, the inner diameter of the first set of friction elements 308A of the spindle 300 may be smaller than the outer diameter of the first end 404 of the body 402 of the mandrel 400 so as to form a desired contact force when the spindle 300 is installed on the mandrel 400. Likewise, the inner diameter of the second set of friction elements 308B of the spindle 300 may be smaller than the outer diameter of the second end 406 of the body 402 of the mandrel 400 so as to form a desired contact force when the spindle 300 is installed on the mandrel 400. For example, when the spindle 300 is installed on the mandrel 400, the first set of friction elements 308A and second set of friction elements 308B may be deflected slightly outward, such as 0.5 mm, 1.0 mm, or the like, by the body 402 of the mandrel 400. This deflection may cause the sets of friction elements 308A, 308B to apply a contact force against the first end 404 and second end 406 of the mandrel 400, respectively. When dispensing a portion of sheet product from the roll 500, the spindle 300 may rotate about the mandrel 400, thereby exerting a friction force upon the mandrel 400 resisting the rotation of the roll 500. In this regard, the contact force against the mandrel 400 and, therefore, the resistance to rotation of the spindle 300 is constant irrespective of a roll of sheet product being installed on the spindle. Additionally, since the contact forces are provided by engagement of the sets of friction elements 308A, 308B with the mandrel 400, the contact forces do not rely on a compressive force from an installed roll of sheet product. As such, the contact forces applied to the mandrel 400 are also constant irrespective of any inconsistencies of an inner surface of the central opening 502 of the roll of sheet product 500. This configuration may provide a consistent resistance to rotation at the desired level, thereby preventing unnecessary extra dispensing and/or over spin while enabling dispensing of the sheet product without premature tearing or separation of perforations.

In an example embodiment, the contact force applied by the first set of friction elements 308A at the first end 404 of the mandrel 400 may be substantially the same as the contact force applied by the second set of friction elements 308B at the second end 406 of the mandrel 400. The contact forces being substantially the same on each end of the spindle 300 and mandrel 400 may, in turn, cause a substantially same resistance to rotation at each end, thereby enabling a balanced rotation of the spindle 300 about the mandrel 400.

Example embodiments of the present invention may be utilized with many different types of sheet product dispensers and spindle assemblies. Additional information regarding some example dispensers and spindle assemblies and their corresponding functionality, such as competitor lock out functionality and door lock features that help reduce unnecessary waste, are described in U.S. Non-Provisional application Ser. No. 16/145,890, entitled "Spindles and Dispensers for Sheet Product", which was filed on the same day as the present application, is assigned to the Assignee of the present application, and is incorporated by reference in its entirety. Although the above examples describe manual sheet product dispensers, some embodiments of the present invention contemplate use of example spindle assemblies with automated sheet product dispensers. Likewise, although the above examples describe sheet product dispensers for tissue paper, some embodiments of the present invention contemplate use of example spindle assemblies with other types of sheet product, such as paper towel, napkins, etc.

Associated systems and methods for manufacturing example sheet product dispensers described herein are also contemplated by some embodiments of the present invention.

CONCLUSION

Many modifications and other embodiments of the inventions set forth herein may come to mind to one skilled in the art to which these inventions pertain having the benefit of the teachings presented in the foregoing descriptions and the associated drawings. Therefore, it is to be understood that the embodiments of the invention are not to be limited to the specific embodiments disclosed and that modifications and other embodiments are intended to be included within the scope of the invention. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the invention. In this regard, for example, different combinations of elements and/or functions than those explicitly described above are also contemplated within the scope of the invention. Although specific terms are employed herein, they are used in a generic and descriptive sense only and not for purposes of limitation.

The invention claimed is:

1. A spindle for supporting a roll of sheet product with respect to a sheet product dispenser, the spindle comprising:

a spindle body configured to be positioned over a mandrel, wherein the spindle body extends along a longitudinal axis of the spindle from a first end to a second end, wherein the spindle body is configured to be received at least partially within a central opening of the roll of sheet product;

a first friction element proximate the first end of the spindle body and extending radially inward from the spindle body so as to provide a contact force against the first end of the mandrel when the spindle is installed on the mandrel; and a second friction element proximate the second end of the spindle body and extending radially inward from the spindle body so as to provide a contact force against the second end of the mandrel when the spindle is installed on the mandrel.

2. An assembly for supporting a roll of sheet product with respect to a sheet product dispenser, the assembly comprising:

a mandrel configured to be positioned within a housing of the sheet product dispenser, wherein the mandrel defines a body with a first end and a second end; and a spindle for supporting a roll of sheet product with respect to the sheet product dispenser, the spindle comprising:

a spindle body configured to be positioned over the mandrel, wherein the spindle body extends along a longitudinal axis of the spindle from a first end to a second end, wherein the spindle body is configured to be received at least partially within a central opening of the roll of sheet product;

a first friction element extending away from the first end of the spindle body and radially inward from the spindle body so as to provide a contact force against the first end of the mandrel when the spindle is installed on the mandrel; and a second friction element extending away from the second end of the spindle body and radially inward from the spindle body so as to provide a contact force against the second end of the mandrel when the spindle is installed on the mandrel.

3. The assembly of claim 2, wherein the contact force against the first end of the mandrel and the contact force against the second end of the mandrel are constant irrespective of whether the roll of sheet product is installed on the spindle.

4. The assembly of claim 2, wherein the spindle body is configured to engage an inner surface corresponding to the central opening of the roll of sheet product when the roll of sheet product is installed on the spindle, wherein the contact force against the first end of the mandrel and the contact force against the second end of the mandrel are constant irrespective of any inconsistencies of the inner surface corresponding to the central opening of the roll of sheet product.

5. The assembly of claim 2, wherein the contact force against the first end of the mandrel as applied by the first friction element is configured to cause substantially the same resistance to rotation about the mandrel as the contact force against the second end of the mandrel as applied by the second frictions element.

6. A sheet product dispenser comprising:

a housing defining a space for receiving at least one roll of sheet product therein;

a mandrel positioned within the housing, wherein the mandrel defines a body with a first end and a second end; and a spindle for supporting a roll of sheet product with respect to the sheet product dispenser, the spindle comprising:

a spindle body configured to be positioned over the mandrel, wherein the spindle body extends along a longitudinal axis of the spindle from a first end to a second end, wherein the spindle body is configured to be received at least partially within a central opening of the roll of sheet product;

a first friction element extending away from the first end of the spindle body and radially inward from the spindle body so as to provide a contact force against the first end of the mandrel when the spindle is installed on the mandrel; and a second friction element extending away from the second end of the spindle body and radially inward from the spindle body so as to provide a contact force against the second end of the mandrel when the spindle is installed on the mandrel.

7. The sheet product dispenser of claim 6, wherein the contact force against the first end of the mandrel and the contact force against the second end of the mandrel are constant irrespective of whether the roll of sheet product is installed on the spindle.

8. The sheet product dispenser of claim 6, wherein an inner diameter of the spindle body at the first end defined at least in part by the first friction element is larger than an inner diameter of the spindle body at the second end defined at least in part by the second friction element.

9. The sheet product dispenser of claim 8, wherein the inner diameter of the spindle body changes linearly from the first end to the second end.

10. The sheet product dispenser of claim 6, wherein the spindle further comprises at least one fin extending radially outward from the spindle body and configured to engage an inner surface corresponding to the central opening of the roll of sheet product such that the spindle rotates with the roll of sheet product.

11. The sheet product dispenser of claim 6, wherein the contact force against the first end of the mandrel as applied by the first friction element is configured to cause substantially the same resistance to rotation about the mandrel as the contact force against the second end of the mandrel as applied by the second frictions element.

12. The sheet product dispenser of claim 6, wherein a center portion of the spindle body disposed between the first friction element and the second friction element is configured to be spaced from and rotate about the mandrel at a predetermined distance away from an outer circumference of the mandrel when the spindle is installed on the mandrel.

13. The sheet product dispenser of claim 6, wherein, when installed on the mandrel, the spindle is configured to rotate about the body of the mandrel while exerting a friction force based on the contact force from the first friction element on the first end of the mandrel and the contact force from the second friction element on the second end of the mandrel.

14. The sheet product dispenser of claim 6, wherein an outer diameter of the first end of the body of the mandrel is larger than an outer diameter of the second end of the body of the mandrel.

15. The sheet product dispenser of claim 14, wherein the outer diameter of the body of the mandrel decreases linearly from the first end to the second end.

16. The sheet product dispenser of claim 14, wherein the outer diameter of the body of the mandrel comprises at least one step decrease between the first end and the second end.

17. The sheet product dispenser of claim 6, wherein the body of the mandrel is fixedly attached to a support at the first end, wherein the mandrel further comprises a nose disposed proximate the second end of the body of the mandrel.

18. The sheet product dispenser of claim 17, wherein the nose defines a lip having a larger outer diameter than the body of the mandrel, wherein, when the spindle is installed on the mandrel, the lip is configured to engage the second friction element to retain the spindle on the mandrel.

19. The sheet product dispenser of claim 6 further comprising:

a second mandrel positioned within the housing, wherein the second mandrel defines a body with a first end and a second end; and a second spindle for supporting a second roll of sheet product with respect to the sheet product dispenser, the second spindle comprising:

a spindle body configured to be positioned over the second mandrel, wherein the spindle body extends along a longitudinal axis of the second spindle from a first end to a second end, wherein the spindle body is configured to be received at least partially within a central opening of the second roll of sheet product;

a first friction element extending away from the first end of the spindle body and radially inward from the spindle body so as to provide a contact force against the first end of the second mandrel when the second spindle is installed on the second mandrel; and a second friction element extending away from the second end of the spindle body and radially inward from the spindle body so as to provide a contact force against the second end of the second mandrel when the second spindle is installed on the second mandrel.

20. The sheet product dispenser of claim 6, wherein the spindle body is configured to engage an inner surface corresponding to the central opening of the roll of sheet product when the roll of sheet product is installed on the spindle, wherein the contact force against the first end of the mandrel and the contact force against the second end of the mandrel are constant irrespective of any inconsistencies of the inner surface corresponding to the central opening of the roll of sheet product.

* * * * *